United States Patent [19]

Nishimura

[11] Patent Number: 4,557,678

[45] Date of Patent: Dec. 10, 1985

[54] PUMP DEVICE

[75] Inventor: Shinji Nishimura, Himeji, Japan

[73] Assignee: Mitsubishi Denki Kabushiki Kaisha, Tokyo, Japan

[21] Appl. No.: 610,433

[22] Filed: May 15, 1984

[30] Foreign Application Priority Data

Jun. 21, 1983 [JP] Japan ..... 58-97331[U]

[51] Int. Cl.[4] ..... F04C 18/00; F04B 11/00

[52] U.S. Cl. ..... 418/180; 418/259; 417/540

[58] Field of Search ..... 418/46, 180, 259, 266–270; 417/540

[56] References Cited

U.S. PATENT DOCUMENTS

| | | | |
|---|---|---|---|
| 2,966,860 | 1/1961 | Maynard | 418/152 |
| 3,121,529 | 2/1964 | Hubrich | 417/540 |
| 3,312,387 | 4/1967 | Cassidy | 418/266 |
| 3,320,899 | 5/1967 | Von Thuengen | 418/180 |

FOREIGN PATENT DOCUMENTS 24307 2/1979 Japan .

*Primary Examiner*—Leonard E. Smith
*Assistant Examiner*—Jane E. Obee
*Attorney, Agent, or Firm*—Oblon, Fisher, Spivak, McClelland & Maier

[57] ABSTRACT

A pump device comprises a housing having an air intake port and an air discharge port, and with its inner peripheral surface being formed in a cylindrical shape; a rotor mounted in said housing and rotating eccentrically in said housing; a plurality of vanes mounted in said rotor and getting into slide-contact with the inner peripheral surface of said housing with rotation of said rotor so as to send under pressure the gas from said air intake port to said air discharge port; a communicating port defined by said vane, the inner peripheral surface of said housing, and the outer peripheral surface of said rotor, and communicatively connected with said operating chamber; and a gas storing chamber for sending and receiving the gas between it and said operating chamber through said communicating port to reduce a pressure differential in said air discharge port and said operating chamber.

7 Claims, 7 Drawing Figures

PUMP DEVICE

BACKGROUND OF THE INVENTION

This invention relates to a pump device, and, more particularly, it is concerned with a vane type vacuum pump device.

As a kind of conventional vacuum pump, there has been known one as disclosed in Japanese Unexamined Pat. publication No. 24307/1979 (which is shown in FIGS. 1 and 2 of the accompanying drawing). In the illustration, a reference numeral 1 designates a housing having an air intake port 1*a*, an air discharge port 1*b*, a cylindrically formed inner peripheral surface 1*c*, and a side wall 1*d*; a numeral 2 refers to a drive shaft rotatably supported in the housing 1. A numeral 3 denotes a rotor fixed on the drive shaft 2, having an outer peripheral surface 3*a*, and which rotates eccentrically within the housing 1 along with rotation of the drive shaft 2; 3*b* refers to a plurality of vane grooves formed in the rotor 3; a numeral 4 denotes a plurality of vanes, each having a side surface 4*a* inserted in each of the vane grooves 3*b*, slide-moving in the vane groove 3*b* in the radial direction of the rotor 3, and being in slide-contact with the inner peripheral surface 1*c* of the housing 1 with rotation of the rotor, to thereby forward under pressure a gas from the air intake port 1*a* to the air discharge port 1*b*. A reference numeral 5 designates a bearing to rotatably support the drive shaft 2; a numeral 6 refers to a bracket which supports thereon the bearing 5, and the side wall 6*a* of which is fixedly secured on the housing 1; reference numerals 7, 8 and 9 designate operating chambers defined by the outer peripheral surface 3*a* of the rotor 3, the inner peripheral surface 1*c* and the side surface 1*d* of the housing 1, the side wall 6*a* of the bracket 6, and a plurality of the vanes 4; a numeral 10 refers to an oil feeding port formed in one part of the housing 1, through which lubricating oil sent from an oil pump (not shown in the drawing) is fed into the housing 1. A reference numeral 11 represents an oil seal to prevent leakage of oil from the housing 1, and a numeral 12 refers to a clearance groove cut out in one part of the inner peripheral surface 1*c* of the housing 1.

In the conventional vacuum pump device of the above-described construction, when the air intake port 1*a* is rendered a high vacuum state by the operation of the pump, the operating chamber 8 is also rendered at a high vacuum condition. In this state, when the operating chamber 8 is opened to the air discharge port 1*b* which is at the atmospheric pressure, there takes place back-flow of air containing lubricating oil from the air discharge port 1*b* to the operating chamber 8 to cause cavitation destruction, cavitation noises, and vibration noises due to pressure waves. With a view to solving such problem, the conventional vacuum pump device has a clearance groove 12 cut in the inner peripheral wall of the housing 1. In more detail, when the vane 4 is passing by the clearance groove 12, air is sent into the operating chamber 8 in the high vacuum condition from the air discharge port 1*b* at the atmospheric pressure through the operating chamber 9 and the clearance groove 12 to bring the pressure in the operating chamber 8 closer to the atmospheric pressure until the operating chamber 8 becomes open to the air discharge chamber 1*b*, thereby preventing the above-mentioned cavitation destruction, etc. from taking place.

On the other hand, however, since the air is supplied into the operating chamber 8 from the air discharge port 1*b* at the time of passing-by of the vane 4 at the clearance groove 12, the operating chamber 8 is brought closer to the atmospheric pressure in a low speed rotational region, whereby a difference in pressure between the operating chamber 8 and the air discharge port 1*b* becomes small. However, since the operating chamber 7 is in the high vacuum condition, a large pressure is applied to the vane 4 separating the operating chamber 7 and the operating chamber 8 to cause one-sided or partial wear of the side surface 4*a* of the vane 4 due to slide-contact with the vane groove 36. Further, in a high speed rotational region, since the vane 4 very quickly passes by the clearance groove 12, a sufficient amount of air cannot be fed into the operating chamber 8 from the air discharge port 1*b* with the consequence that the cavitation destruction, and other undesirable phenomena cannot sufficiently be prevented.

SUMMARY OF THE INVENTION

It is therefore an object of the present invention to provide an improved vacuum pump device which has solved the disadvantages inherent in the conventional vacuum pump device as has been pointed out in the foregoing.

It is another object of the present invention to provide an improved vacuum pump device which is provided with a communicating port having a small cross-sectional area and communicatively connected with the pump housing, and further provided with a gas storing chamber for sending and receiving a gas between it and the operating chamber through the communicating port so as to reduce the pressure differential in the gas discharge port and the operating chamber, thereby suppressing wear of the side surface of the vanes in the entire rotational region, and also suppressing cavitation destruction, cavitation nosies, and vibrating sounds owing to pressure waves.

According to the present invention, in general aspect there is provided a pump device, housing in combination, a housing having an air intake port and an air discharge port, and with its inner peripheral surface being formed in a cylindrical shape; a rotor mounted in said housing and rotating eccentrically in said housing; a plurality of vanes mounted in said rotor and in slide-contact with the inner peripheral surface of said housing with rotation of said rotor so as to send under pressure the gas from said air intake port to said air discharge port; a communicating port defined by said vane, the inner peripheral surface of said housing, and the outer peripheral surface of said rotor, and communicatively connected with said operating chamber; and a gas storing chamber for sending and receiving the gas between it and said operating chamber through said communicating port to reduce a pressure differential in said air discharge port and said operating chamber.

BRIEF DESCRIPTION OF THE DRAWINGS

The foregoing objects, other objects, as well as specific construction and function of the vacuum pump device according to the present invention will become more apparent and understandable form the following detailed description thereof, when read in conjunction with the accompanying drawing.

In the accompanying drawing.

Figure is a longitudinal cross-sectional view of still another embodiment of the vacuum pump device according to the present invention; and

DETAILED DESCRIPTION OF THE PREFERRED EMBODIMENTS

Figure 2:
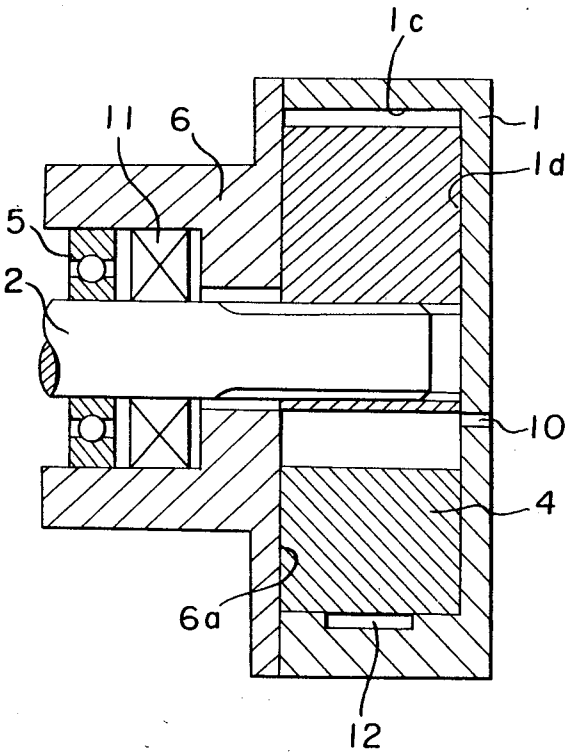
FIGURE 2 PRIOR ART
FIG. 2 is a longitudinal cross-sectional view of the pump device shown in FIG. 1, taken along a line II—II.
Figure 1:
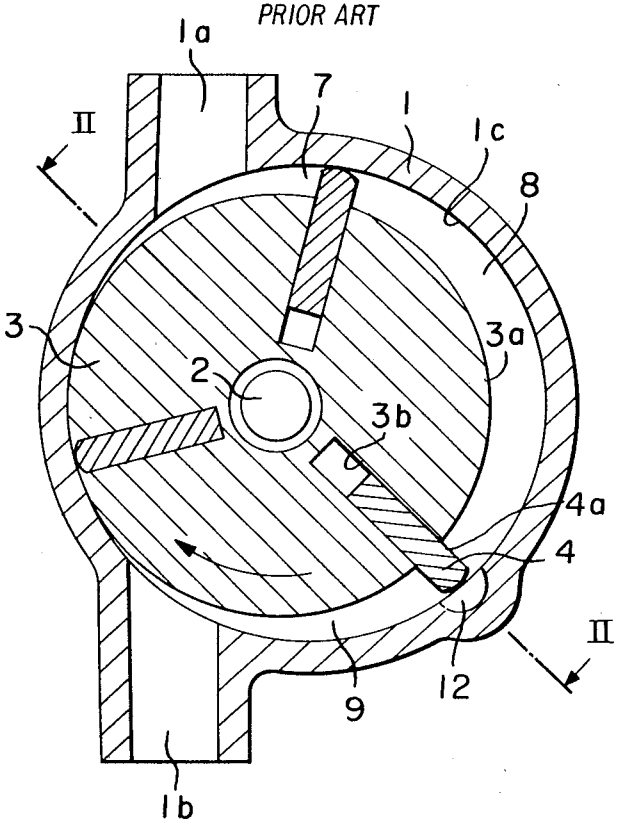
FIGURE 1 PRIOR ART
FIG. 1 is a cross-sectional view showing a conventional vacuum pump device.
Figure 4:
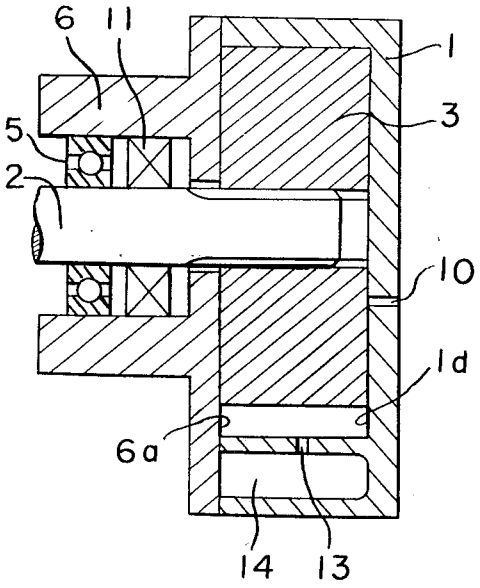
FIG. 4 is a longitudinal cross-sectional view of the pump device shown in FIG. 3, taken along a line IV—IV.
Figure 3:
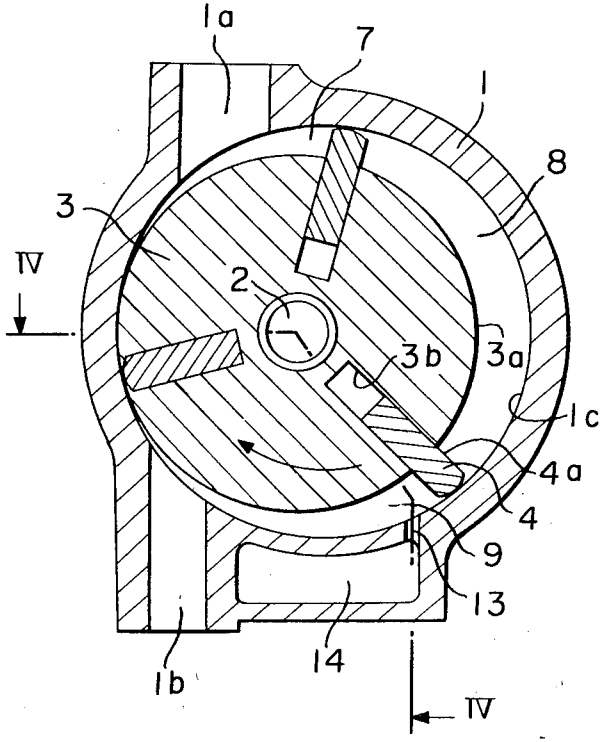
FIG. 3 is a cross-sectional view showing one preferred embodiment of the vacuum pump device according to the present invention.

In the following, the present invention will be explained in specific reference to FIGS. 3 and 4 illustrating one preferred embodiment of the present invention.

In the drawing, a reference numeral 13 designates a communicating port having a small cross-sectional area, and being communicatively connected with an operating chamber 8 to be defined by the inner peripheral surface 1*c* of a housing 1, the outer peripheral surface 3*a* of a rotor 3, and a vane 4. The communicating port 13 is formed at a position to the upstream side of a gas discharge port 1*b* and in the vicinity thereof. A numeral 14 refers to an air storing chamber, as a gas storing chamber, which is integrally formed with the housing 1.

Figure 7:
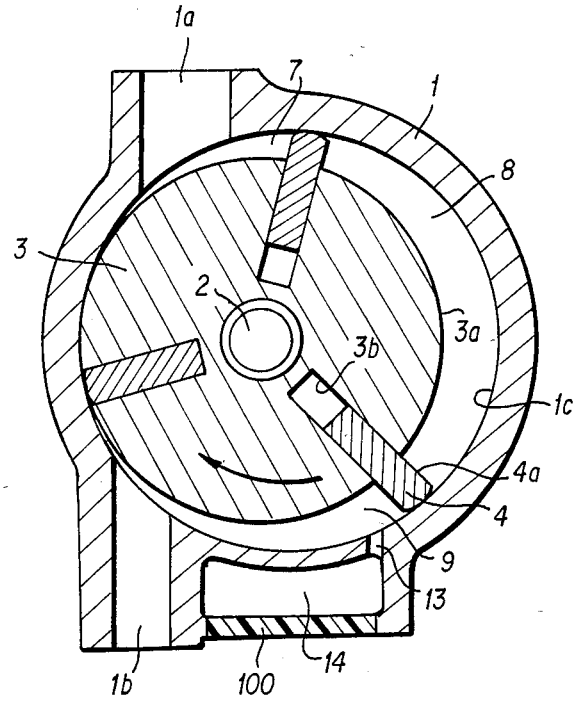

FIG. 7 shows a variation of the embodiment of FIG. 3 in which a portion of the air storing chamber is made of elastic material. This air storing chamber sends and receives air between it and the operating chamber 8 through the communicating port 13 to reduce a pressure differential in the gas discharge port 1*b* and the operating chamber 8.

The air storing chamber is otherwise sealed. The rest of the construction of the pump device is same as those of the conventional pump device, hence those parts identical with, or equivalent to, those in the conventional construction are labelled with the same reference numerals, and the explanations thereof will be dispensed with.

In the following, operations of the pump device according to the present invention will be described. When the rotor 3 is driven for rotation by its drive shaft 2 in the direction of an arrow mark, the vane 4 is urged to the inner peripheral surface 1*c* of the housing 1 owing to the centrifugal force, simultaneously rotating in slide-contact with the inner peripheral surface 1*c* of the housing 1. As the consequence of this, an operating chamber 7 moves from the side of the gas intake port 1*a* to the side of the gas discharge port 1*b* by way of the states designated by the reference numerals 8 and 9 along with rotation of the rotor 3. When the operating chamber is open to the gas intake port 1*a* as shown by a numeral 7, the operating chamber 7 continues its expansion stroke. When the operating chamber is open to the gas discharge port 1*b* as shown by a numeral 9, the operating chamber 9 continues its compression stroke. By repetition of the above-mentioned expansion and compression strokes, a vacuum tank, etc. (not shown in the drawing) connected with the gas intake port 1*a* is rendered at a vacuum. As the result of this, the gas intake port 1*a* is brought to the vacuum condition. However, when the pressure at the gas intake port 1*a* is atmospheric or at a low degree of vacuum, the pressure in the operating chamber 8 becomes higher than the atmospheric pressure by the compression stroke. Further, when the operating chamber 8 becomes communicative with the air storing chamber 14 by further rotation of the rotor 3, air in the operating chamber 8 flows into the air storing chamber 14 through the communicating port 13, because the pressure in the operating chamber 8 is higher than the pressure in the air storing chamber 14. Accordingly, both operating chamber 8 and gas discharging port 1*b* are brought into communication with the pressure in the operating chamber 8 having been decreased, whereby vibrating noises to be generated by a pressure differential between the operating chamber 8 and the gas discharge port 1*b* are suppressed. On the other hand, when the vacuum degree in the gas intake port 1*a* becomes high as a result of the pump action over a period of time, the operating chamber 8 remains at its high vacuum condition even in its compression stroke. However, with rotation of the rotor 3, when the operating chamber 8 becomes communicative with the air storing chamber 14, the pressure in the air storing chamber 14 is higher than the pressure in the operating chamber 8 with the consequence that air in the air storing chamber 14 flows into the operating chamber 8 through the communicating port 13. Accordingly, the operating chamber 8 comes to communicate with the gas discharge port 1*b* in the state of its vacuum degree not being so high. Therefore, it becomes possible to prevent back-flow of air containing lubricating oil from the gas discharge port 1*b* into the housing 1, whereby the cavitation destruction, the cavitation noise, and the vibrating noises due to pressure waves can be suppressed to a satisfactory extent. At this time, air is caused to flow from the gas discharge port 1*b* to the air storing chamber 14 through the operating chamber 9, and, when the subsequent operating chamber 8 becomes communicative with the air storing chamber 14, the air to be fed into the operating chamber 8 is stored in the air storing chamber 14. Incidentally, even when the rotor 3 is rotating at a low speed, the quantity of air flowing into the operating chamber 8 from the air storing chamber 14 only reaches a point where the pressure in the air storing chamber 14 and the pressure in the operating chamber 8 become equal, hence the pressure differential between the operating chamber 8 and the operating chamber 7 does not become so great. Accordingly not so much force is imparted to the vane separating the operating chamber 7 and the operating chamber 8, whereby partial wear of the vane can be prevented. On the other hand, even when the rotor 3 rotates at a high speed, the air supply from the air storing chamber 14 to the operating chamber 8 can be sufficiently done during a time period from communication of the operating chamber 8 with the air storing chamber 14 until its comunication with the gas discharge port 1*b*. Also, since the air supply from the gas discharge port 1*b* to the air storing chamber 14 can be sufficiently done by rotation of the vane 4 during a period from the communication of the air storing chamber 14 with the gas discharge port 1*b* until interruption of the communication between them, favorable result can be obtained, even when the rotor 3 is rotating at a high speed.

As stated in the foregoing, this embodiment of the vacuum pump device according to the present invention is so constructed that the communicating port 13 having a small cross-sectional area is provided in the housing 1, and also the air storing chamber 14 is provided for reducing the pressure differential between the gas discharge port 1*b* and the operating chamber 8 by sending and receiving air between it and the operating chamber 8 through this communicating port 13, whereby wear of the side surface 4*a* of the vane 4 can be suppressed at the entire rotational region of the rotor 3, and also the cavitation destruction, the cavitation noise, and the vibrating noises due to the pressure waves can be suppressed. Further, even if the air storing chamber 14 becomes communicative with the operating chamber 8, there takes place limited pressure variations, because the volume of the air storing chamber 14 is limited.

In the following, another embodiment of the vacuum pump device according to the present invention will be explained in reference to FIG. 5.

Figure 5:
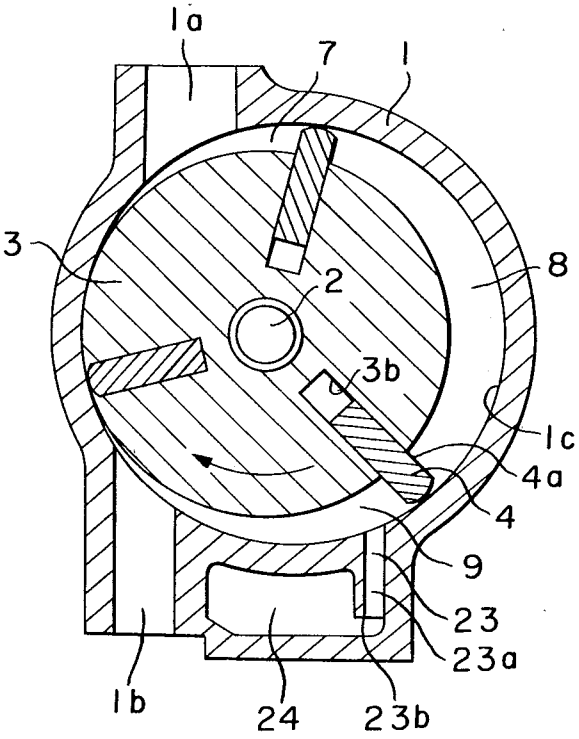
FIG. 5 is a cross-sectional view showing another embodiment of the vacuum pump device according to the present invention.

In FIG. 5, a reference numeral 23 designates a communicating port having a small cross-sectional area, a vertical passageway 23*a* of a predetermined length, and a bottom end 23*b*, and a numeral 24 refers to the air storing chamber, as the gas storing chamber, which is integrally formed with the housing 1. A part of this air storing chamber 24 is provided at a level higher than the bottom end 23*b* of the communicating port 23. The air storing chamber 24 sends and receives air between it and the operating chamber 8 through communicating port 23 to reduce the pressure differential in the gas discharge port 1*b* and the operating chamber 8. The remainder of the construction of the vacuum pump device is same as those in the conventional pump device, hence those parts which are identical with, or equivalent to, those in the conventional pump device are designated by the same reference numerals, and the explanations for them are dispensed with. Also, the operations of the pump device in this embodiment are identical with those of the previous embodiment as shown in FIGS. 3 and 4, hence the detailed explanations therefor are dispensed with.

As described in the foregoing, the vacuum pump device according to this second embodiment is also capable of suppressing wear and tear of the side surface 4*a* of the vane 4 in the entire rotational region of the rotor 3 as well as suppressing the cavitation destruction, the cavitation noise, and the vibrating noises due to the pressure wave, as is the case with the embodiment in FIG. 3. Also, since the cross-sectional area of the passageway 23*a* is small, and a part of the air storing chamber 24 is provided at a level higher than the bottom end 23*b* of the communicating port 23, the lubricating oil which has flowed into the air storing chamber 24 is sucked into the operating chamber 8 by the pressure differential between the operating chamber 8 and the air storing chamber 24, and is discharged outside the housing 1 from the gas discharge port 1*b* together with air. On acount of this, the capacity of the air storing chamber 24 becomes always maintained substantially constant, whereby the pressure differential between the operating chamber 8 and the gas discharge port 1*b* can be effectively reduced.

Figure 6:
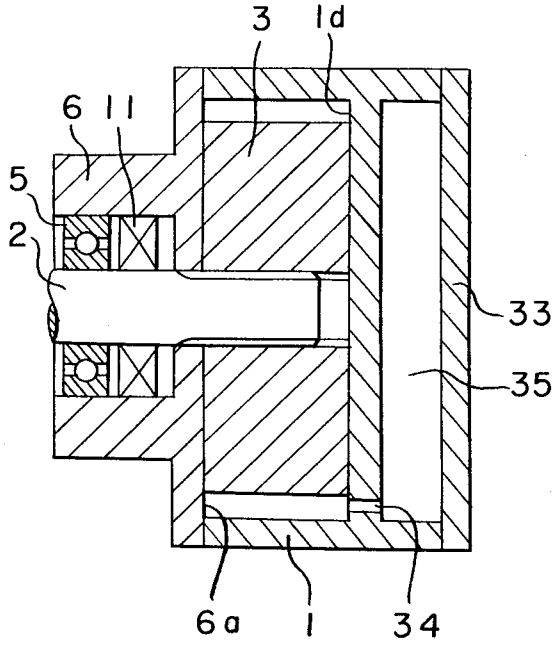

In the following, still another embodiment of the pump device according to the present invention will be described in reference to FIG. 6. In FIG. 6, a reference numeral 33 designates a bracket fixedly secured to the housing 1, a numeral 34 refers to a communicating port having a small cross-sectional area, and formed at the lower part of the side wall 1*d* of the housing 1, and a reference numeral 35 denotes an air storing chamber, as the gas storing chamber, defined by both housing 1 and bracket 33, the entire part of which is disposed above the communicating port 34. The air storing chamber is communicatively connected with the operating chamber 8, and sends and receives air between it and the operating chamber 8 to reduce the pressure differential in the gas discharge port 1*b* and the operating chamber 8. The remainder of the construction in this vacuum pump device is same as those in the conventional vacuum pump device, hence those parts which are identical with, or equivalent to, those in the conventional vacuum pump device are designated by the same reference numerals, and the explanations for these parts are dispensed with. Also, the operations of the pump device in this embodiment are identical with the operations in the previous two embodiments shown in FIGS. 3 through 5, hence the detailed explanations of the operations are dispensed with.

As described in the foregoing, since the vacuum pump device according to this embodiment forms the communicating port 34 at the lower part of the side wall 1*d* of the housing 1, the quantity of the lubricating oil flowing into the air storing chamber 35 is decreased, and, even if it has flowed into it, the lubricating oil is discharged into the operating chamber 8 through the communicating port 34 together with air to be sent in from the air storing chamber 35, after which it is discharged outside by the gas discharge port 1*b*. Accordingly, the capacity of the air storing chamber 35 becomes substantially constant, and the pressure differential between the operating chamber 8 and the gas discharge port 1*b* can be constantly reduced with good efficiency.

In the afore-described embodiments of the vacuum pump device according to the present invention, the air storing chamber is formed integrally with the housing, without exception, although it may be formed as a separate body from the housing 1. Further, when a part or all of the air storing chamber is formed of an elastic material 100 (FIG. 7), the volume of the air storing chamber changes according to the pressure within the operating chamber 8, owing to which the pressure differential between the operating chamber 8 and the air storing chamber can be reduced with good efficiency by sending and receiving air between the two chambers by expansion and contraction of the air storing chamber in accordance with the pressure differential between the operating chamber 8 and the air storing chamber. Furthermore, the shape of the air storing chamber is not unchangeably fixed, but sufficient effect can be attained with any shape such as, for example, a tubular shape, if it has a volume which is able to store therein sufficient quantity of air.

As stated in the foregoing, the pump device according to the present invention is so constructed that a communicating port is provided in communicative connection with the operating chamber within the housing, through which gas is sent in and out between the air storing chamber and the operating chamber to reduce the pressure differential in the gas discharge port and the operating chamber, followed by discharging of the gas in the operating chamber from the gas discharge port. As the consequence of this, it is possible to provide the vacuum pump device capable of suppressing wear and tear of the side surface of the vane in the entire rotational region in the operating chamber, and, at the same time, of suppressing the cavitation destruction, the cavitation noise, and the vibrating noises due to the pressure waves.

Although the present invention has been described in the foregoing with reference to particular embodiments thereof, it will be understood by those skilled in the art that the invention is capable of variety of alternative embodiments within the spirit and scope of the invention as set forth in the appended claims.

I claim:

1. A pump device, comprising in combination:

(a) a housing having an air intake port and an air discharge port, and with an inner peripheral surface of said housing being formed in a cylindrical shape;

(b) a rotor mounted in said housing and rotating eccentrically in said housing;

(c) a plurality of vanes mounted in said rotor and in sliding contact with the inner peripheral surface of said housing due to rotation of said rotor so as to deliver under pressure the gas from said air intake port to said air discharge port;

(d) an operating chamber defined by said vane, the inner peripheral surface of said housing, and the outer peripheral surface of said rotor;

(e) communicating port means communicatively connected with said operating chamber; and (f) a gas storing chamber communicating with said operating chamber, said gas storing chamber communicating with said operating chamber through said communicating port means to reduce a pressure differential between said air discharge port and said operating chamber, said gas storing chamber being sealed except for said communicating port means.

2. The pump device according to claim 1, wherein said communicating port means is provided at a position to the upstream side and in the vicinity of said gas discharge port.

3. The pump device according to claim 1, wherein said communicating port means has a passage having a cross-sectional area which is smaller than the cross-sectional area of the gas storing chamber.

4. The pump device according to claim 1, wherein said gas storing chamber is formed integrally with said housing.

5. The pump device according to claim 1, wherein at least a part of said gas storing chamber is constructed of an elastic material.

6. The pump device according to claim 1, wherein an oil feeding port is formed in said housing for feeding lubricating oil into said housing.

7. The pump device according to claim 6, wherein said communicating port means has a passage extending into said gas storing chamber such that at least a part of said gas storing chamber is provided above an open end of said communicating port means passage.

* * * * *